United States Patent [19]

Ohtaka et al.

[11] Patent Number: 4,926,825

[45] Date of Patent: May 22, 1990

[54] AIR-FUEL RATIO FEEDBACK CONTROL METHOD FOR INTERNAL COMBUSTION ENGINES

[75] Inventors: Shoichi Ohtaka; Hisashi Igarashi, both of Wako, Japan

[73] Assignee: Honda Giken Kogyo K.K. (Honda Motor Co., Ltd. in English), Tokyo, Japan

[21] Appl. No.: 278,024

[22] Filed: Nov. 30, 1988

[30] Foreign Application Priority Data

Dec. 7, 1987 [JP] Japan ..... 62-310314
Dec. 7, 1987 [JP] Japan ..... 62-310315

[51] Int. Cl.[5] ..... F02M 25/08; F02D 41/14
[52] U.S. Cl. ..... 123/489; 123/520
[58] Field of Search ..... 123/440, 489, 518, 519, 123/520, 589

[56] References Cited

U.S. PATENT DOCUMENTS

| | | | |
|---|---|---|---|
| 4,377,142 | 3/1983 | Otsuka et al. | 123/440 |
| 4,467,769 | 8/1984 | Matsumura | 123/489 |
| 4,641,623 | 2/1987 | Hamburg | 123/440 X |
| 4,646,702 | 3/1987 | Matsubara et al. | 123/489 X |
| 4,664,087 | 5/1987 | Hamburg | 123/489 X |
| 4,748,959 | 6/1988 | Cook et al. | 123/489 X |
| 4,821,701 | 4/1989 | Nankee, II et al. | 123/489 X |
| 4,834,050 | 5/1989 | Uranishi et al. | 123/489 X |

FOREIGN PATENT DOCUMENTS 0003449 1/1985 Japan .
0233328 11/1985 Japan .

*Primary Examiner*—Willis R. Wolfe
*Attorney, Agent, or Firm*—Arthur L. Lessler

[57] ABSTRACT

A method of controlling in a feedback manner the air-fuel ratio of an air-fuel mixture being supplied to an internal combustion engine of the type that vaporized fuel is supplied from a fuel supply system to an intake system thereof. The air-fuel ratio is controlled by the use of a correction value which varies in response to an output from an exhaust gas ingredient sensor, and the maximum or minimum value of which is limited to an upper or lower limit value. The pressure of the vaporized fuel in the fuel supply system is sensed, and at least one of the upper and lower limit values is set in accordance with the sensed pressure of the vaporized fuel. Further, the air-fuel ratio is controlled by the use of an average value of the correction value. The pressure of the vaporized fuel in the fuel supply system is sensed, and the calculation of the average value is inhibited when the sensed pressure of the vaporized fuel is higher than a predetermined value.

13 Claims, 4 Drawing Sheets

| FIG. 2A | |
|---|---|
| FIG. 2B | |

AIR-FUEL RATIO FEEDBACK CONTROL METHOD FOR INTERNAL COMBUSTION ENGINES

BACKGROUND OF THE INVENTION

The present invention relates to an air-fuel ratio feedback control method for an internal combustion engine which is of the type that vaporized fuel is supplied from a fuel tank to the engine.

Conventionally, an air-fuel ratio feedback control method for an internal combustion engine is known, in which during operation of the engine in an air-fuel ratio feedback control region, the air-fuel ratio of a mixture supplied to the engine is controlled to a desired value by the use of a coefficient which varies with change in the output of an exhaust gas ingredient concentration sensor arranged in the exhaust system of the engine, so as to achieve excellent exhaust emission characteristics and reduce fuel consumption.

Further, an air-fuel ratio feedback control method of this type has been proposed by the assignee of the present application, e.g. in Japanese Provisional Patent Publication (Kokai) No. 60-3449, in which when the coefficient assumes a value falling outside a predetermined range, the coefficient is held at an upper or lower limit value of &he predetermined range, and then the coefficient value or upper or lower limit value is applied to the feedback control to thereby prevent excessive correction of the air-fuel ratio, and hence engine stalling, etc. due to the excessive correction when an abnormal output is produced from the exhaust gas ingredient concentration sensor due to malfunction of same.

In the meanwhile, internal combustion engines in general are equipped with a canister or the like which temporarily stores vaporized fuel produced in a fuel tank and supplies same to the engine during operation of the engine in order to prevent the vaporized fuel from being emitted into the air. When the aforesaid conventional air-fuel ratio feedback control method is applied to an internal combustion engine equipped with the canister, there arises a problem that it is impossible to attain both of the above-mentioned objects, i.e., excellent exhaust emission characteristics and reduced fuel consumption, and prevention of excessive correction of the air-fuel ratio in the event of an abnormal output of the exhaust gas ingredient concentration sensor.

More specifically, when a great amount of vaporized fuel is present in the fuel tank at a high temperature, the vaporized fuel is supplied in great quantities to the engine together with proper fuel supplied from a fuel supplying device, such as fuel injection valves, during operation of the engine, that is, the total amount of fuel supplied to the engine is temporarily increased, to overrich the air-fuel ratio of a mixture supplied to the engine. This impedes attainment of excellent exhaust emission characteristics and reduced fuel consumption. The excessive enrichment of the mixture leads to a large change in the value of the coefficient to a lean side. However, in the aforesaid conventional method, the excessive enrichment of the air-fuel ratio due to the supply of vaporized fuel was not taken into consideration. Therefore, even if the coefficient assumes a value falling outside the predetermined range not because an abnormal output is produced from the malfunctioning exhaust gas ingredient concentration sensor but because vaporized fuel is actually supplied in great quantities to the engine, the coefficient is limited to the value within the predetermined range which is constant. Consequently, the air-fuel ratio feedback control cannot be effected to such a sufficient degree as to cope with the excessive enrichment of the mixture, so that satisfactory exhaust emission characteristics and reduced fuel consumption cannot be secured.

On the other hand, if the predetermined range is set to a wider range so as for the feedback control to cope with the excessive enrichment of the mixture, it is impossible to cope with an abnormal output from the exhaust gas ingredient concentration sensor, and hence to avoid the above-mentioned problems of excessive correction of the air-fuel ratio and the resulting engine stalling.

In the meanwhile, an air-fuel ratio feedback control method for an internal combustion engine has been proposed by the present assignee, e.g. in Japanese Provisional Patent Publication (Kokai) No. 60-233328, in which during operation of the engine in an air-fuel ratio feedback control region, the air-fuel ratio of a mixture supplied to the engine is controlled by the use of either a coefficient which varies with change in the output of an exhaust gas ingredient concentration sensor arranged in the exhaust system of the engine or an average value of the coefficient.

According to this proposed control method, it is determined whether the engine is operating in a feedback control region or an operating region other than the feedback control region. When the engine is operating in the feedback control region, it is determined whether the engine is operating in an idling region or an operating region other than the idling region. When the engine is operating in the idling region, or in the operating region other than the idling region, an average value of values of the coefficient obtained in each region is calculated and stored for use in each region. When the engine has shifted to one of these operating regions within the feedback control region, the average value stored for the one region to which the engine has shifted is used as an initial value of the coefficient to thereby start the air-fuel ratio feedback control. Thus, the coefficient can be set to a proper initial value at the start of the feedback control, whereby the accuracy of the feedback control is improved.

However, if this method is applied to the abovedescribed type of internal combustion engine to which vaporized fuel is supplied by way of a canister or the like during operation of the engine, there arises a problem that the air-fuel ratio is leaned when the engine has shifted to the feedback control region, which can even cause engine stalling.

More specifically, in order to cope with the aforementioned excessive enrichment of the air-fuel ratio caused by the supply of vaporized fuel to the engine, the coefficient or the average value thereof is automatically shifted to a value which leans the mixture, even if the engine is operating in the same region within the feedback control region. As a result, in the case where a great amount of vaporized fuel was present at the end of the immediately preceding operation of the engine in a region within the feedback control region, and a small amount of vaporized fuel is present when the engine has returned to the same region within the feedback control region, the above-mentioned average value obtained during the immediately preceding feedback control operation, which has been shifted to a value leaning the mixture due to the supply of vaporized fuel to the engine, is used as an initial value of the coefficient, which results in an overlean air-fuel ratio of the mixture, and even in engine stalling if the degree of leaning of the mixture is great.

SUMMARY OF THE INVENTION

It is an object of the invention to provide an air-fuel ratio feedback control method for an internal combustion engine, which is capable of preventing degradation of the exhaust emission characteristics and increase of the fuel consumption when a great amount of vaporized fuel is supplied from a fuel tank to the engine, and at the same time also capable of preventing excessive correction of the air-fuel ratio and hence engine stalling when an abnormal output is produced from the exhaust gas ingredient concentration sensor.

It is another object of the invention to provide an air-fuel ratio feedback control method for an internal combustion engine, which is capable of preventing leaning of the mixture and hence engine stalling when the engine has shifted to the feedback control region, after a great amount of vaporized fuel was supplied during immediately preceding operation of the engine in the feedback control region.

According to a first aspect of the invention, there is provided a method of controlling in a feedback manner the air-fuel ratio of an air-fuel mixture being supplied to an internal combustion engine having an intake system, a fuel supply system, means for supplying vaporized fuel from the fuel supply system to the intake system during operation of the engine, an exhaust system, and sensor means arranged in the exhaust system for sensing the concentration of an exhaust gas ingredient therein, wherein during operation of the engine in an air-fuel ratio feedback control region, the air-fuel ratio is controlled by the use of a correction value which varies in response to an output from the sensor means and the maximum or minimum value of which is limited to an upper or lower limit value.

The method according to the first aspect of the invention is characterized by comprising the steps of sensing the pressure of the vaporized fuel in the fuel supply system, and setting at least one of the upper and lower limit values in accordance with the sensed pressure of the vaporized fuel.

Preferably, the upper and lower limit values are set to higher and lower values, respectively, as the pressure of the vaporized fuel is higher.

In a preferred embodiment of the invention, the value of the correction value is limited within a predetermined range, and the predetermined range is set to a wider range as the sensed pressure of the vaporized fuel is higher.

According to a second aspect of the invention, there is provided a method of controlling in a feedback manner the air-fuel ratio of an air-fuel mixture being supplied to an internal combustion engine having an intake system, a fuel supply system, means for supplying vaporized fuel from the fuel supply system to the intake system during operation of the engine, an exhaust system, and sensor means arranged in the exhaust system for sensing the concentration of an exhaust gas ingredient therein, wherein during operation of the engine in an air-fuel ratio feedback control region, an average value of a correction value which varies in response to an output from the sensor means is calculated, and the air-fuel ratio is controlled by the use of the average value.

The method according to the second aspect of the invention is characterized by comprising the steps of:

(a) sensing the pressure of the vaporized fuel in the fuel supply system;

(b) determining whether the sensed pressure of the vaporized fuel is higher than a predetermined value; and (c) inhibiting the calculation of the average value when the sensed pressure of the vaporized fuel is higher than the predetermined value.

Preferably, the average value is used as an initial value of the correction value at the start of the air-fuel ratio feedback control in the air-fuel ratio feedback control region.

The above and other objects, features and advantages of the invention will become more apparent from the ensuing detailed description taken in conjunction with the accompanying drawings.

DETAILED DESCRIPTION

The method according to the invention will now be described in detail with reference to the drawings showing embodiments thereof.

Figure 1:
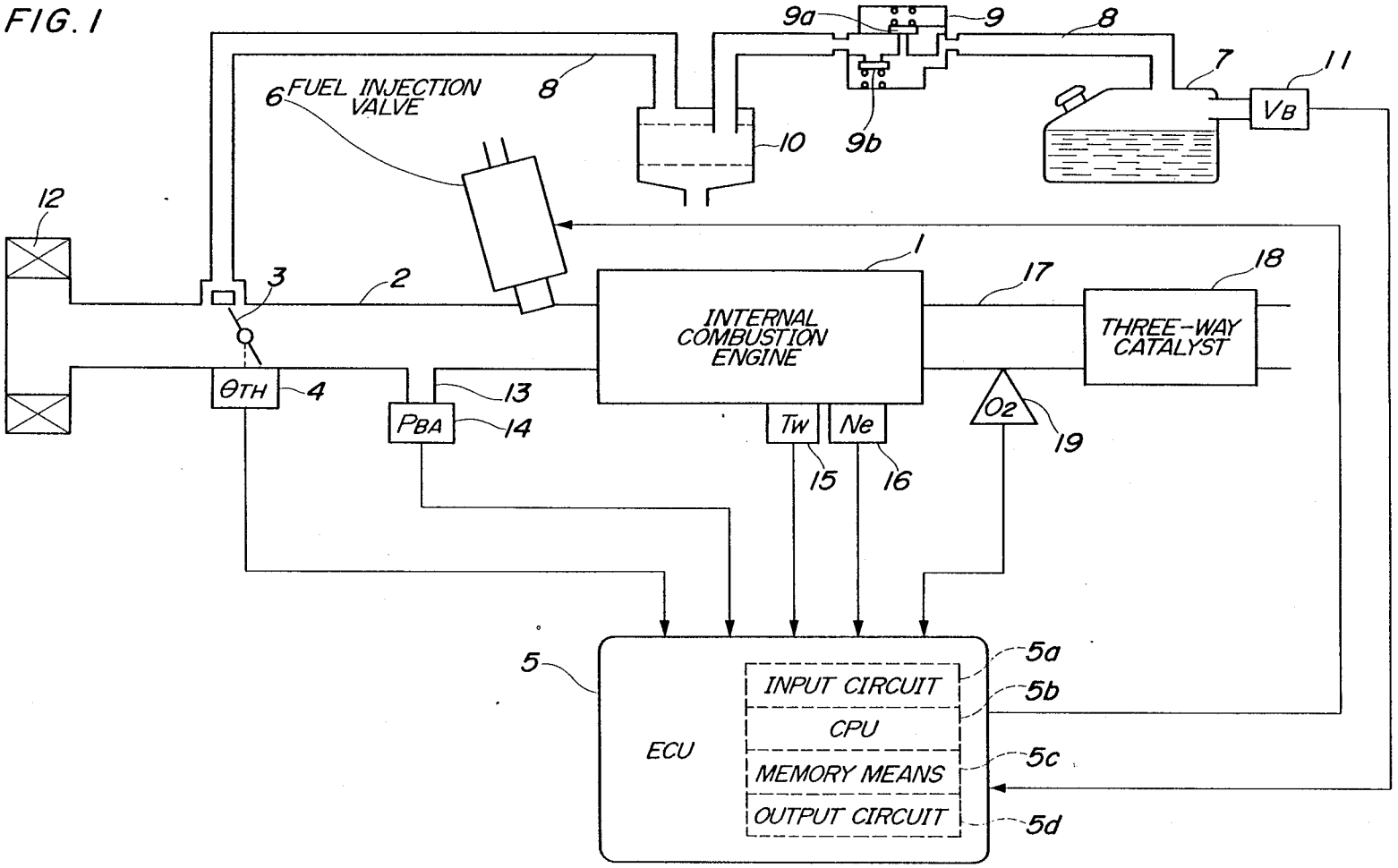
FIG. 1 is a block diagram illustrating the whole arrangement of a fuel supply control system to which is applied the air-fuel ratio feedback control method according to the invention.

Referring first to FIG. 1, there is illustrated the whole arrangement of a fuel supply control system for an internal combustion engine, to which the method according to the invention is applied. Reference numeral 1 designates an internal combustion engine which may be a four-cylinder type, for instance. Connected to the engine 1 is an intake pipe 2 which has an air cleaner 12 arranged at an upstream end thereof, and a throttle valve 3 arranged intermediately between the air cleaner 12 and the engine 1. Connected to the throttle valve 3 is a throttle valve opening ($\theta$th) sensor (hereinafter referred to as "the $\theta$th sensor") 4 for detecting the valve opening ($\theta$th) of the throttle valve 3 and converting same into an electric signal which is supplied to an electronic control unit (hereinafter referred to as "the ECU") 5.

Fuel injection valves 6 are arranged in the intake pipe intermediately between the engine 1 and the throttle valve 3, each at a location slightly upstream of a corresponding intake valve, not shown, for each cylinder. Each fuel injection valve 6 is connected to a fuel tank 7, which will be referred to later, by way of a fuel pump, not shown, and a conduit, not shown. The fuel injection valves 6 are also electrically connected to the ECU so that opening periods of time, i.e. amounts of liquid fuel to be supplied to the engine 1, are controlled by driving signals from the ECU 5.

Connected to the intake pipe 2 in the vicinity of the throttle valve 3, is an outlet end of a vaporized fuel passage 8 which communicates the intake pipe 2 with an upper space within the fuel tank 7. The outlet end of the passage 8 is bifurcated to open into the intake pipe 2 at both upstream and downstream sides of the throttle valve 3 when the throttle valve 3 is closed. A two-way valve g and a canister 10 are arranged across the vaporized fuel passage 8, in this order from the fuel tank side. The two-way valve 9 comprises a positive pressure valve 9a which is adapted to open when positive pressure developed in the upper space of the fuel tank 7, i.e. the gasifed fuel pressure has reached a predetermined value due to a rise in the temperature of the fuel tank 7, whereby vaporized fuel is delivered through the valve 9a into the canister 10 and stored therein, and a negative pressure valve 9b which is adapted to open when negative pressure developed in the upper space of the fuel tank 7 has exceeded a predetermined value due to a fall in the temperature of the fuel tank 7, whereby vaporized fuel temporarily stored in the canister 10 is returned to the fuel tank 7 through the valve 9b. The vaporized fuel stored in the canister 10 is supplied to the intake pipe 2 due to negative pressure developed in the intake pipe 2 and supplied to the engine 1 during operation thereof.

A fuel tank internal pressure sensor (hereinafter referred to as "the $V_B$ sensor") 11 is arranged in the upper space of the fuel tank 7 for detecting vaporized fuel pressure $V_B$ in the fuel tank 7 and converting same into an electrical signal which is supplied to the ECU.

An absolute pressure ($P_{BA}$) sensor (hereinafter referred to as "the $P_{BA}$ sensor") 14 communicates through a conduit 13 with the interior of the intake pipe 2 at a location downstream Of the throttle valve 3. The $P_{BA}$ sensor 8 detects absolute pressure in the intake pipe 2 and supplies an electrical signal indicative of the detected absolute pressure to the ECU 5.

An engine coolant temperature ($T_W$) sensor 15, which may be formed of a thermistor or the like, is mounted in the cylinder block of the engine 1 in a manner embedded in the peripheral wall of an engine cylinder having its interior filled with coolant, detects engine coolant temperature ($T_W$), and supplies an electrical signal indicative of the detected engine coolant temperature ($T_W$) to the ECU 5.

An engine rotational speed sensor (hereinafter referred to as "the Ne sensor") 16 is arranged in facing relation to a camshaft, not shown, of the engine 1 or a crankshaft, not shown, of same. The Ne sensor is adapted to generate a pulse of a top-dead-center position (TDC) signal (hereinafter referred to as "the TDC signal") at a predetermined crank angle position of each cylinder of the engine which comes a predetermined crank angle earlier relative to the top-dead-center position (TDC) at which the suction stroke thereof starts, whenever the engine crankshaft rotates through 180 degrees. The TDC signal pulse generated by the Ne sensor is supplied to the ECU 5.

A three-way catalyst 18 is arranged in an exhaust pipe 17 extending from the cylinder block of the engine 1 for purifying ingredients HC, CO, and NOx contained in the exhaust gases. An $O_2$ sensor 19 as sensor means for sensing concentration of an exhaust gas ingredient is inserted in the exhaust pipe 12 at a location upstream of the three-way catalyst 18 for detecting the concentration of oxygen ($O_2$) in the exhaust gases and supplying an electrical signal indicative of the detected oxygen concentration to the ECU 5.

The ECU 5 comprises an input circuit 5a having functions of shaping pulse waveforms of output signals from some engine operating parameter sensors, shifting the voltage levels of output signals from other engine operating parameter sensors to a predetermined voltage level, converting the voltage-shifted analog signals into digital signals etc., a central processing unit (hereinafter referred to as "the CPU") 5b, memory means 5c storing control programs executed in the CPU 5b and for storing various calculated values from the CPU 5b, and an output circuit 5d for supplying driving signals to the fuel injection valves 6.

The CPU 5b operates in response to various engine operating parameter signals stated above, to determine operating conditions or operating regions in which the engine is operating, such as a feedback control region and open loop control regions, and then to calculate the fuel injection period $T_{OUT}$ for which the fuel injection valves 6 should be opened, in accordance with the determined operating conditions or regions of the engine and in synchronism with generation of pulses of the TDC signal, by the use of the following equation (1).

$$T_{OUT}=T_i\times K_{02}\times K_1+K_2 \ldots \quad (1)$$

where $T_i$ represents a basic value of the valve opening period for the fuel injection valves 6, and is calculated from a Ti map, not shown, stored in the memory means 5c in accordance with the absolute pressure ($P_{BA}$) and the engine rotational speed (Ne), for example. $K_{02}$ is an air-fuel ratio feedback correction coefficient which is calculated in accordance with a $K_{02}$ calculation subroutine (FIG. 2) described hereinafter. $K_1$ and $K_2$ are other correction coefficients and correction variables, respectively, and are calculated based on various engine parameter signals to such values as optimize engine characteristics, such as fuel consumption and engine accelerability.

The ECU 5 supplies driving signals to the fuel injection valves 6 by way of the output circuit 5d to open the valves over the thus calculated fuel injection period $T_{OUT}$.

Figures 2, 2A:
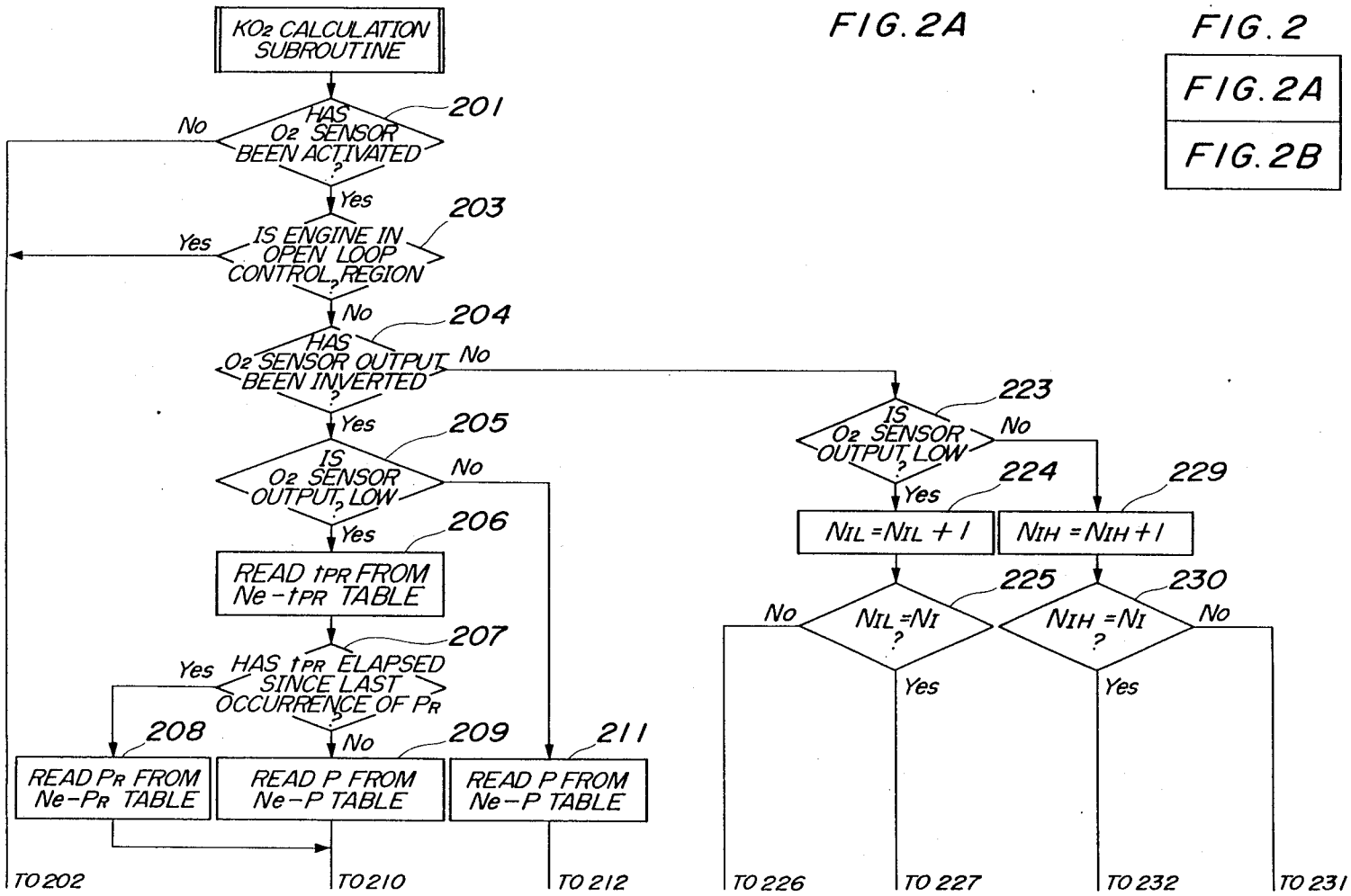
FIG. 2 is a flowchart showing a subroutine for calculating the value of a correction coefficient $K_{02}$.
Figure 2B:
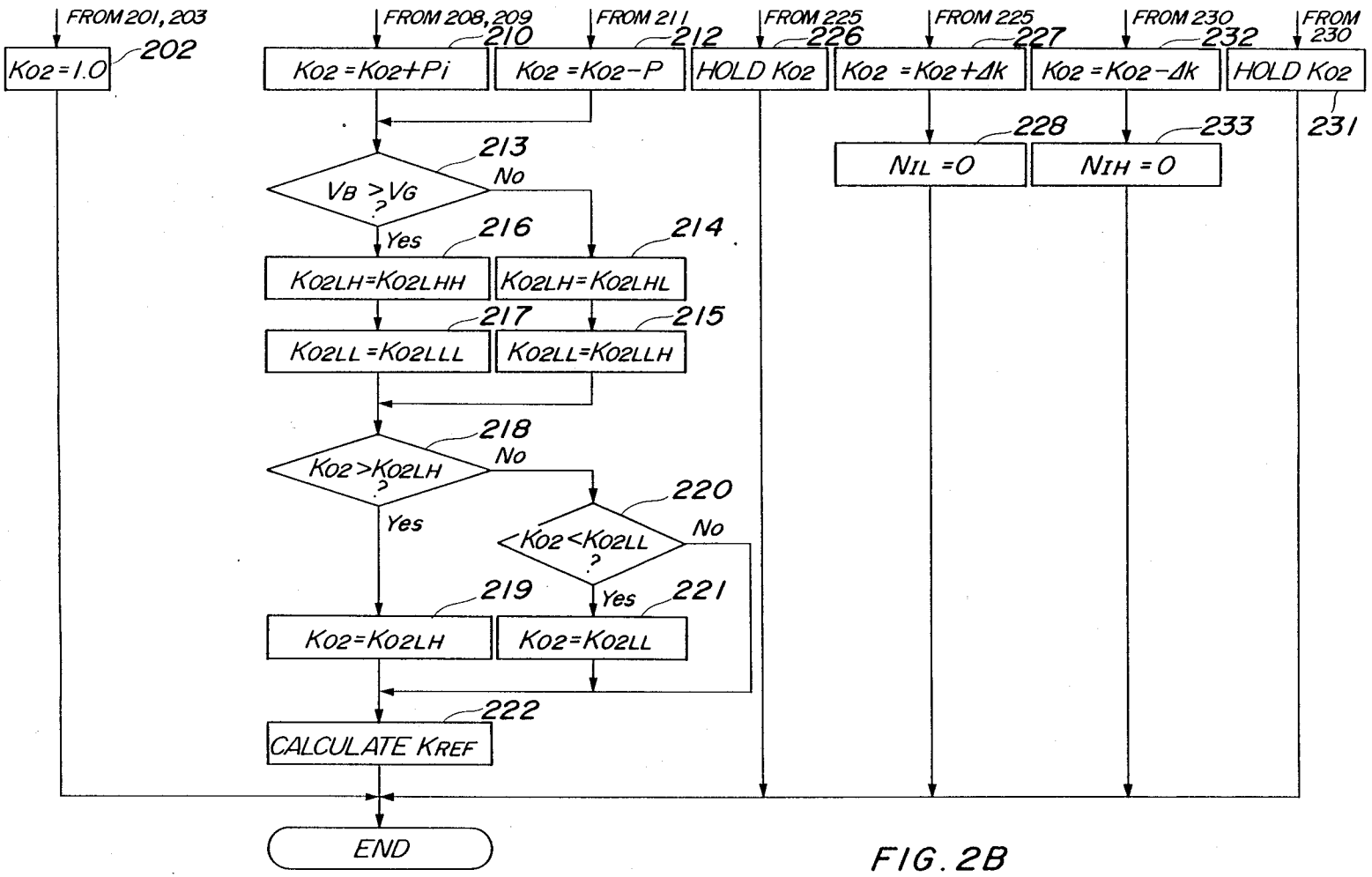

FIG. 2 shows a flowchart of a subroutine for calculating the air-fuel ratio feedback correction coefficient $K_{02}$ according to the invention. This program is executed upon generation of each TDC signal pulse.

First it is determined at a step 201 whether or not the $O_2$ sensor 19 has become activated. More specifically, it is determined whether the output voltage from the $O_2$ sensor 19 has dropped to an activation point $V_x$ (e.g. 0.6 V) with a decrease in the internal resistanse of the $O_2$ sensor 19. When the activation point $V_x$ has been reached, it is judged that the $O_2$ sensor has become activated. If the answer to the question at the 201 is No, the air-fuel ratio feedback correction coefficient $K_{02}$ has its value set to 1.0 at a step 202, followed by terminating the present program. If the answer to the question at the step 201 is Yes, it is determined at a step 203 whether the engine 1 is operating in an open loop control region. The open loop control region includes a full load operating (WOT) region, a low engine speed region, a high engine speed region, a mixture leaning region, etc.

If the answer to the question at the step 203 is Yes, the aforementioned step 202 is executed, i.e. the correction coefficient $K_{02}$ has its value set to 1.0, followed by terminating the present program. Then. as is conventionally known in the art, the correction coefficients $K_1$ in the aforementioned equation (1) are set to values corresponding to the engine operating conditions, and open loop control is carried out by applying the values to the equation (1).

On the other hand, if the answer to the question at the step 203 is No, it is determined that the engine 1 is operating in a feedback control region, and feedback control is carried out. First, it is determined at a step 204 whether or not the output of the $O_2$ sensor 19 has been inverted. If the answer to the question at the step 204 is Yes, i.e. if the output of the $O_2$ sensor 19 has been inverted, proportional control or P-term control of the air-fuel ratio is carried out at steps 205 to 212. That is, it is determined at a step 205 whether or not the output level of the $O_2$ sensor is low. If the answer at the step 205 is Yes, a predetermined period of time $t_{PR}$ depending on the engine rotational speed Ne is read from an Ne-$t_{PR}$ table stored in the memory means 5c (step 206). The predetermined time period $t_{PR}$ is used for maintaining constant the frequency with which a second correction value $P_R$ referred to hereinafter is applied, over the whole engine rotational speed range. To this end, it is set to smaller values as the engine rotational speed Ne increases.

Next, it is determined at a step 207 whether or not the above-mentioned predetermined period of time $t_{PR}$ has elapsed after the second correction value $P_R$ was applied last time. If the answer at the step 207 is Yes, the second correction coefficient value $P_R$ is read from the Ne-$t_{PR}$ table (step 208), while if the answer at the step 207 is No, a first correction value P depending on the engine rotational speed Ne is read from an Ne-P table stored in the memory means 5c (step 209). The first correction value P is set to a value smaller than the second correction value $p_R$ at the same engine rotational speed Ne. Then at a step 210, a correction value Pi, i.e. the first correction value P or the second correction value $P_R$ read as above, is added to the correction coefficient $K_{02}$. On the other hand, if the answer at the step 206 is No, similarly to the step 209, the correction value P is read from tbe Ne-P table (step 211), and at a step 212 the first correction P is subtracted from the correction coefficient $K_{02}$.

Thus, when the output of the $O_2$ sensor 19 has been inverted, the first correction value P or the second correction value $P_R$ depending on the engine rotational speed Ne is added to or subtracted from the correction coefficient $K_{02}$ so as to correct the latter in a direction reverse to the output level-inverting direction.

Then, at steps 213 to 221, upper and lower limit values $K_{02LH}$ and $K_{02LL}$ of the correction coefficient $K_{02}$ are set based on the vaporized fuel pressure $V_B$ within the fuel tank 7. First, at the step 213, it is determined whether or not the vaporized fuel pressure $V_B$ in the fuel tank 7 is above a predetermined value $V_G$ (e.g. atmospheric pressure +35 mmHg). If the answer at the step 213 is No, that is, in the case where $V_B$ is not higher than $V_G$ and therefore it is not presumed that a great amount of vaporized fuel is present in the upper space of the fuel tank 7 and the canister 10, the upper and lower limit values $K_{02LH}$ and $K_{02LL}$ of the correction coefficient $K_{02}$ are set to first predetermined values $K_{02LHL}$ (e.g. 1.1) and $K_{02LLH}$ (e.g. 0.9), respectively steps 214 and 215), and then tbe program proceeds to a step 218 described hereinafter.

On the other hand, if the answer at the step 213 is Yes, that is, in the case where $V_B$ is higher than $V_G$ and therefore it is presumed that a great amount of vaporized fuel is present in the upper space of the fuel tank 7 and the canister 10, the upper limit value $K_{02LH}$ of the correction coefficient $K_{02}$ is set to a second predetermined value $K_{02LHH}$ (e.g. 1.2) which is larger than the first predetermined value $K_{02LHL}$ (step 216), and the lower limit value $K_{02LL}$ of the correction coefficient $K_{02}$ is set to a second predetermined value $K_{02LLL}$ (e g. 0.8) which is smaller than the first predetermined value $K_{02LLH}$ (step 217), followed by the program proceeding to step 218. In other words, in the case where $V_B$ is higher than $V_G$, the applicable range of the correction coefficient $K_{02}$ is made wider than in the case where $V_B$ is not higher than $V_G$.

At the step 218, it is determined whether or not the value of the correction coefficient $K_{02}$ calculated at the step 210 or 212 is larger than the upper limit value $K_{02LH}$ set at the aforementioned Step 214 or 216. If the answer at the step 218 is Yes, that is, in the case where the current correction coefficient $K_{02}$ is larger than the lower limit value $K_{02LH}$, the correction coefficient $K_{02}$ is held at the upper limit value $K_{02LH}$ (step 219), followed by the program proceeding to a step 222 described hereinafter. If the answer at the step 218 is No, it is determined at a step 220 whether or not the correction coefficient $K_{02}$ is smaller than the lower limit value $K_{02LL}$ set at the step 215 or 217. If the answer at step the 220 is Yes, that is, in the case where the correction coefficient $K_{02}$ is smaller than the lower limit value $K_{02LL}$, the correction coefficient $K_{02}$ is held at the lower limit value $K_{02LL}$ (step 221), followed by the program proceeding to the step 222. If the answer at the step 220 is NO, that is, in the case where the correction coefficient $K_{02}$ is not smaller than the lower limit value $K_{02LL}$ and not larger than the higher limit value $K_{02LH}$, the program proceeds to the step 222.

As described above, when the vaporized fuel pressure $V_B$ is higher than the predetermined pressure value $V_G$, the applicable range of the correction coefficient $K_{02}$ is made wider, so that if a great amount of vaporized fuel is supplied to the engine 1, the correction coefficient $K_{02}$ can be changed over the wider range to thereby enable correcting the air-fuel ratio over a correspondingly wider range by means of feedback control and hence improve exhaust emission characteristics, fuel consumption, etc. On the other hand, if the vaporized fuel pressure $V_B$ is not higher than the predetermined pressure value $V_G$, the applicable range of the correction coefficient $K_{02}$ is made narrower, so that if the exhaust gas ingredient concentration detecting system has outputted an abnormal value, excessive correction of the air-fuel ratio can be prevented, and therefore engine stall due to the excessive correction can be prevented.

Further, in the embodiment described above, the vaporized fuel pressure $V_B$ is detected in terms of a continuous variable value, and when the detected value is higher than the predetermined pressure value $V_G$, the applicable range of the correction coefficient $K_{02}$ is widened by a fixed amount. However, the present invention is not limited to this, but for instance, the applicable range may be varied in a continuous manner in response to the vaporized fuel pressure $V_B$. Further, instead of the $V_B$ sensor 11, a switch may be arranged in the fuel tank, which turns on or off depending on whether the vaporized fuel pressure $V_B$ is higher than a predetermined pressure value, and the applicable range may be set in a manner similar to the above-described embodiment, in response to a signal from the switch.

At the step 222, the value of the correction coefficient $K_{02}$ calculated at the step 210 or 212, or held at the upper limit $K_{02LH}$ or the lower limit $K_{02LL}$ at the step 219 or 221 is used to calculate an average value $K_{REF}$ thereof by the use of the below-given equation (2), and the calculated average value $K_{REF}$ is stored into the memory means 5c, followed by terminating the program. The average value $K_{REF}$ is calculated according to a $K_{REF}$ calculation subroutine described hereinafter with reference to FIG. 3. If the present loop belongs to a feedback control region other than a feedback control-effecting idling region. $K_{REF1}$ or $K_{REF2}$ is calculated as $K_{REFn}$, whereas if the present loop belongs to the idling region, $K_{REFO}$ is calculated as KREFn.

$$K_{REFn}=C_n\times K_{02P}+(1\times C_n)\times K_{REFn'}\ldots \quad (2)$$

where $K_{02P}$ is a value of $K_{02}$ obtained immediately before or immediatelY after operation of proportional control or P-term control, $C_n$ a variable experimentally set to a suitable value ($0<C_n<1$) for each feedback control region, and $K_{REFn'}$ an average value of $K_{02}$ obtained up to the immediately preceding loop in a feedback control region to which the present loop belongs.

The ratio of $K_{02P}$ to $K_{REFn}$ obtained at each P-term control operation depends on the value of variable $C_n$. Therefore, it is possible to obtain a most suitable $K_{REFn}$ ($K_{REF0}$, $K_{REF1}$, or $K_{REF2}$) by suitably setting $C_n$ to a value within the abovementioned range ($0<C_n<1$) depending on the characteristics of an air-fuel ratio feedback control system to which the present invention is applied, the engine, etc. The average value $K_{REFn}$ ($K_{REF0}$, $K_{REF1}$, or $K_{REF2}$) of $K_{02}$ thus obtained is used as an initial value of the correction coefficient $K_{02}$ to thereby start the air-fuel ratio feedback control, when the engine 1 has shifted to one of operating regions within the feedback control region for which the corresponding average value $K_{REFn}$ is stored.

Returning to the step 204, if the answer is No, that is, if the output of the $O_2$ sensor 19 has not been inverted, the integral control (I-term control) of the air-fuel ratio is executed at steps 223 et seq. First, at the step 223, similarly to the abovementioned step 205, it is determined whether or not the output level of the $O_2$ sensor 19 is low. If the answer at the step 223 is Yes, that is, if the output level of the $O_2$ sensor 19 is low, the number of pulses of the TDC signal inputted is counted (step 224), and then it is determined at the step 225 whether or not the counted number $N_{IL}$ has reached a predetermined value $N_I$. If the answer at the step 225 is No the correction coefficient $K_{02}$ is maintained at an immediately preceding value (step 226), while if the answer at the step 225 is Yes, a predetermined value $\Delta K$ is added to the correction coefficient $K_{02}$ (step 227) and the above-mentioned counted number $N_{IL}$ is reset to 0 (step 228), thus adding the predetermined value $\Delta K$ to the $K_{02}$ each time $N_{IL}$ reaches $N_I$.

If the answer at the step 223 is No, the number of pulses of the TDC signal inputted is counted (step 229), and it is determined at a step 230 whether or not the counted number $N_{IH}$ has reached the predetermined value $N_I$. If the answer at the step 230 is No, the correction coefficient $K_{02}$ is maintained at an immediately preceding value (step 231).

If the answer at the step 230 is Yes, the predetermined value $\Delta K$ is subtracted from the correction coefficient $K_{02}$ (step 232), and the abovementioned counted number $N_{IH}$ is reset to 0 (step 233), thus subtracting the predetermined value $\Delta K$ from the correction coefficient $K_{02}$ each time the counted number $N_{IH}$ reaches the predetermined value $N_I$.

Thus, so far as the output of the $O_2$ sensor 19 is maintained at a lean or rich level, the predetermined value $\Delta K$ is added to or subtracted from the correction coefficient $K_{02}$ in such a direction as to correct the value $K_{02}$ so as to obtain a desired air-fuel ratio, whenever the number of counted pulses of the TDC signal inputted reaches the predetermined value $N_I$.

Figure 3:
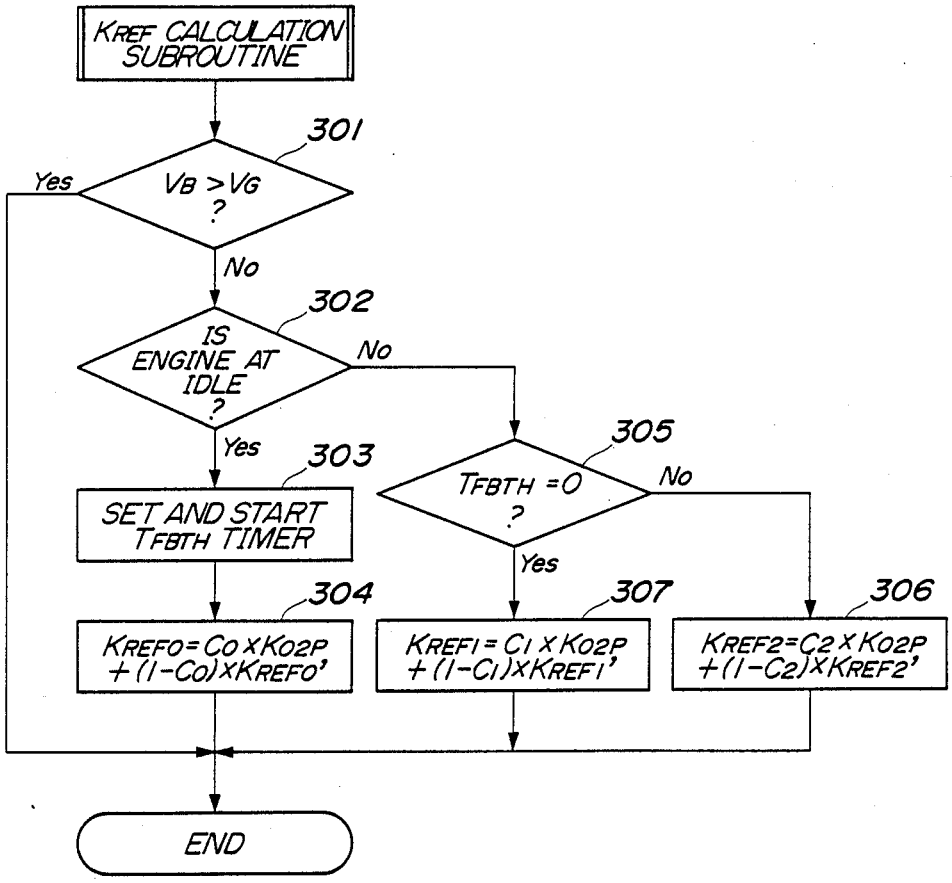
FIG. 3 is a flowchart showing a subroutine for calculating the average values $K_{REF}$ of the correction coefficient $K_{02}$.

FIG. 3 shows a flowchart of a subroutine for calculating an average value $K_{REF}$ of the air-fuel ratio feedback correction coefficient $K_{02}$, which is executed at the step 222 in FIG. 2.

First, it is determined at a step 301 whether or not the vaporized fuel pressure $V_B$ is higher than the predetermined pressure value $V_G$. If the answer at the step 301 is Yes, that is, if the vaporized fuel pressure $V_B$ is higher than the predetermined pressure value $V_G$, the present program is terminated. That is, when the vaporized fuel pressure $V_B$ is so high that it is presumed that a great amount of vaporized fuel is present in the canister etc., the calculation of the average value $K_{REF}$ of $K_{02}$ is inhibited. Therefore, by thus inhibiting the calculation, even if the air-fuel ratio of a mixture supplied to the engine 1 becomes rich temporarily, and the correction coefficient $K_{02}$ is changed accordingly so as to make the mixture leaner, the average value $K_{REF}$ of $K_{02}$ is not affected by this change in $K_{02}$. The average value KREF calculated only when the pressure $V_B$ is below the predetermined value $V_G$ is used as an initial value of the correction coefficient $K_{02}$ at the start of the next feedback control in the feedback control region. Therefore, irrespective of the presence of a great amount of vaporized fuel at the start of the feedback control, leaning of the air-fuel ratio and hence engine stalling can be prevented.

The step 301 may be replaced by a step wherein the aforesaid switch which turns on or off when $V_B$ is above $V_G$ is used in place of the $V_B$ sensor 11 and the output signal of the switch is used to determine whether $V_B$ is above $V_G$.

If the answer at the step 301 is No, that is, if the vaporized fuel pressure $V_B$ is not higher than the predetermined pressure value $V_G$ and therefore it is not presumed that a great amount of vaporized fuel is present in the canister 10 etc., it is determined at a step 302 whether or not the engine 1 is in the feedback control-effecting idling region. This determination is carried out by determining whether the engine rotational speed Ne is lower than a predetermined value and at the same time the intake absolute pressure $P_{BA}$ is lower than a predetermined value. If the answer at the step 302 is Yes, that is, if the engine 1 is in the idling region, an initial count value $T_{FBTH}$ of a $T_{FBTH}$ timer formed by a down counter is set to a predetermined period of time and the timer is started (step 303). Then, the average value $K_{REFO}$ of $K_{02}$ obtained in the idling region is calculated according to the equation (2) (step 304), followed by terminating the program.

If the answer at the step 302 is No, that is if the engine 1 is in a feedback control region other than the idling region, it is determined at a step 305 whether or not the count value $T_{FBTH}$ of the $T_{FBTH}$ timer started at the step 303 is equal to 0. If the answer at the step 305 is No, the average value $K_{REF2}$ is calculated according to the equation (2) (step 306), followed by terminating the program. Thus, the average value $K_{REF2}$ is calculated only from the time the engine 1 has shifted from the idling region to the feedback control region other than the idling region to the time the predetermined period of time elapses.

If the answer at the step 305 is Yes, the average value $K_{REF1}$ is calculated according to the equation (2) (step 307), followed by terminating the program. Thus, the average value $K_{REFl}$ is calculated only after the predetermined period of time has elapsed from the time the engine 1 shifts from the idling region to the feedback control region.

What is claimed is:

1. In a method of controlling in a feedback manner the air-fuel ratio of an air-fuel mixture being supplied to an internal combustion engine having an intake system, a fuel supply system, means for supplying vaporized fuel from said fuel supply system to said intake system during operation of said engine, an exhaust system, and sensor means arranged in said exhaust system for sensing the concentration of an exhaust gas ingredient therein, wherein during operation of said engine in an air-fuel ratio feedback control region, the air-fuel ratio is controlled by the use of a correction value which varies in response to an output from said sensor means and the maximum or minimum value of which is limited to an upper or lower limit value, the improvement comprising the steps of sensing the pressure of said vaporized fuel in said fuel supply system, and setting at least one of said upper and lower limit values in accordance with the sensed pressure of said vaporized fuel.

2. A method as claimed in claim 1, wherein said fuel supply system includes a fuel tank, and the pressure within said fuel tank is sensed as the pressure of said vaporized fuel.

3. A method as claimed in claim 1 or claim 2, wherein said upper limit value is set to a higher value as the pressure of said vaporized fuel is higher.

4. A method as claimed in claim 1 or claim 2, wherein said lower limit value is set to a lower value as the pressure of said vaporized fuel is higher.

5. A method as claimed in claim 1, wherein said correction value is a coefficient by which is multiplied a basic fuel quantity which is determined by at least one operating parameter of said engine.

6. In a method of controlling in a feedback manner the air-fuel ratio of an air-fuel mixture being supplied to an internal combustion engine having an intake system, a fuel supply system, means for supplying vaporized fuel from said fuel supply system to said intake system during operation of said engine, an exhaust system, and sensor means arranged in said exhaust system for sensing the concentration of an exhaust gas ingredient therein, wherein during operation of said engine in an air-fuel ratio feedback control region, the air-fuel ratio is controlled by the use of a correction value which varies in response to an output from said sensor means and the value of which is limited within a predetermined range, the improvement comprising the steps of sensing the pressure of said vaporized fuel in said fuel supply system, and setting said predetermined range to a wider range as the sensed pressure of said vaporized fuel is higher.

7. A method as claimed in claim 6, wherein said predetermined range is determined by an upper limit value and a lower limit value, and said upper limit value is set to a higher value and said lower limit value to a lower value as the pressure of said vaporized fuel is higher.

8. A method as claimed in claim 1 or claim 6, including the steps of:

(a) calculating an average value of values of said correction value obtained during operation of said engine in said air-fuel ratio feedback control region;

(b) determining whether the sensed pressure of said vaporized fuel is higher than a predetermined value; and (c) inhibiting said calculation of said average value when the sensed pressure of said vaporized fuel is higher than said predetermined value.

9. A method as claimed in claim 8, wherein said average value is used as an initial value of said correction value at the start of the air-fuel ratio feedback control in said air-fuel ratio feedback control region.

10. In a method of controlling in a feedback manner the air-fuel ratio of an air-fuel mixture being supplied to an internal combustion engine having an intake system, a fuel supply system, means for supplying vaporized fuel from said fuel supply system to said intake system during operation of said engine, an exhaust system, and sensor means arranged in said exhaust system for sensing the concentration of an exhaust gas ingredient therein, wherein during operation of said engine in an air-fuel ratio feedback control region, an average value of a correction value which varies in response to an output from said sensor means is calculated, and the air-fuel ratio is controlled by the use of said average value, the improvement comprising the steps of:

(a) sensing the pressure of said vaporized fuel in said fuel supply system;

(b) determining whether the sensed pressure of said vaporized fuel is higher than a predetermined value; and (c) inhibiting said calculation of said average value when the sensed pressure of said vaporized fuel is higher than said predetermined value.

11. A method as claimed in claim 10, wherein said average value is used as an initial value of said correction value at the start of the air-fuel ratio feedback control in said air-fuel ratio feedback control region.

12. A method as claimed in claim 10 or claim 11, wherein said correction value is a coefficient by which is multiplied a basic fuel quantity which is determined by at least one operating parameter of said engine.

13. A method as claimed in claim 10 or claim 11, wherein said fuel supply system includes a fuel tank, and the pressure within said fuel tank is sensed as the pressure of said vaporized fuel.

* * * * *